US008315419B2

(12) United States Patent
Graff et al.

(10) Patent No.: US 8,315,419 B2
(45) Date of Patent: Nov. 20, 2012

(54) SOUND PRODUCING SYSTEM

(75) Inventors: Allen T. Graff, Sutton, MA (US); Robert Preston Parker, Westborough, MA (US); John R. Bruss, Chula Vista, CA (US)

(73) Assignee: Bose Corporation, Framingham, MA (US)

( * ) Notice: Subject to any disclaimer, the term of this patent is extended or adjusted under 35 U.S.C. 154(b) by 993 days.

(21) Appl. No.: 12/179,739

(22) Filed: Jul. 25, 2008

(65) Prior Publication Data

US 2010/0021000 A1 Jan. 28, 2010

(51) Int. Cl.
*H04R 1/00* (2006.01)

(52) U.S. Cl. ..... 381/398; 381/399

(58) Field of Classification Search ..... 381/398–399
See application file for complete search history.

(56) References Cited

U.S. PATENT DOCUMENTS

| | | | | |
|---|---|---|---|---|
| 1,953,523 | A | 4/1932 | Wolff | |
| 3,108,653 | A | 10/1963 | Valldeperas | |
| 3,716,671 | A | 2/1973 | Karr | |
| 5,339,286 | A * | 8/1994 | Esposto | 367/140 |
| 5,517,573 | A | 5/1996 | Polk et al. | |
| 5,805,708 | A | 9/1998 | Freadman | |
| 5,809,154 | A | 9/1998 | Polk | |
| 5,929,393 | A | 7/1999 | Jeter, Jr. | |
| 6,597,792 | B1 | 7/2003 | Sapiejewski et al. | |

FOREIGN PATENT DOCUMENTS

| | | | |
|---|---|---|---|
| GB | 2003996 | A | 3/1979 |
| JP | 58 029289 | A | 2/1983 |
| JP | 59062728 | A | 4/1984 |
| JP | 60-174387 | A | 11/1985 |
| JP | 05030593 | A | 2/1993 |
| JP | 11098596 | A | 4/1999 |
| JP | 11136786 | A | 5/1999 |
| JP | 11150780 | A | 6/1999 |
| JP | 2002232987 | A | 8/2002 |

OTHER PUBLICATIONS

International Search Report and Written Opinion for PCT/US2009/048278, dated Nov. 3, 2009.
International Search Report on Patentability dated Feb. 3, 2011, 10 pages, for PCT/US2009/048278.
Invitation to Pay Additional Fees dated Sep. 22, 2009 for International application No. PCT/US2009/048278.
JP Decision of Rejection dated Feb. 28, 2012 for JP Application No. 2010-522108.
JP Office Action dated Oct. 4, 2011 for JP Application No. 2010-522108.

* cited by examiner

*Primary Examiner* — Richard A. Booth

(57) ABSTRACT

A sound producing system includes an electro-acoustic transducer having an electromagnetic motor for moving a diaphragm of the transducer back and forth to create acoustic waves. The diaphragm has a surface that includes one or more of a surface of a dust cap of the diaphragm, a surface of a cone of the diaphragm, and a portion of a surface of a surround of the diaphragm. A solid gas impermeable cover faces the diaphragm surface and has a surface which faces the diaphragm surface. At least a portion of the cover surface has a contour which is substantially the same as a contour of the diaphragm surface. The system includes an asymmetric exit for the acoustic waves to leave a volume defined between the diaphragm surface and the cover surface.

22 Claims, 3 Drawing Sheets

SOUND PRODUCING SYSTEM

FIELD OF THE INVENTION

This invention is in the field of acoustics and more specifically relates to a sound producing apparatus.

BACKGROUND

A goal of some developers of sound producing apparatus is to provide more acoustic power in a smaller product package. Obtaining a smaller product package can be challenging, particularly where a waveguide is used to enhance the low frequency output of the apparatus. Typically, an electro-acoustic transducer emits acoustic waves into the waveguide. The air volume located adjacent to the transducer adds to the size of the apparatus. If the air volume adjacent to the transducer could be minimized, the size of the apparatus could be reduced.

Providing more acoustic power in a smaller product package often involves using a more powerful electromagnetic motor in the electro-acoustic transducer. The use of a more powerful motor increases the amount of stray magnetic flux generated by the motor that extends beyond the product package. If the sound producing apparatus is placed too close to another electronic device (e.g. a video monitor), the stray magnetic flux could damage the electronic device. Containing the magnetic flux is important in order to not damage other electronic devices.

SUMMARY

According to a first aspect of the invention, a sound producing system includes an electro-acoustic transducer having an electromagnetic motor for moving a diaphragm of the transducer back and forth to create acoustic waves. The diaphragm having a surface that includes one or more of a surface of a dust cap of the diaphragm, a surface of a cone of the diaphragm, and a portion of a surface of a surround of the diaphragm. A solid gas impermeable cover faces the diaphragm surface and has a surface which faces the diaphragm surface. At least a portion of the cover surface has a contour which is substantially the same as a contour of the diaphragm surface. The system includes an asymmetric exit for the acoustic waves to leave a volume defined between the diaphragm surface and the cover surface.

There can be a minimum gap between at least a portion of the diaphragm surface and at least a portion of the cover surface of between about 2.5 mm to about 3.5 mm when the diaphragm surface portion is closest to the cover surface portion during movement of the diaphragm surface. The cover can be made of a material that has a magnetic permeability of at least about 900 N/A2. The cover can be made of cold rolled steel. The cover can include an integral portion which partially defines the exit. The integral portion of the cover can also partially defines an entrance to a waveguide of the system. The diaphragm surface can include both the surface of the dust cap and the surface of the cone. Acoustic waves exiting the volume defined between the diaphragm surface and the cover surface can travel in a direction which is substantially perpendicular to a direction of travel of the diaphragm surface.

According to a second aspect of the invention, a sound producing system includes an electro-acoustic transducer having an electromagnetic motor for moving a diaphragm of the transducer back and forth to create acoustic waves that are transmitted to a listening environment outside the system. A solid gas impermeable cover faces the diaphragm surface. The cover is made of a material that has a magnetic permeability of at least about 900 $N/A^2$.

The diaphragm can include a surface that can include one or more of a surface of a dust cap of the diaphragm, a surface of a cone of the diaphragm, and a portion of a surface of a surround of the diaphragm. The cover can have a surface which faces the diaphragm surface, at least a portion of the cover surface having a contour which is substantially the same as a contour of the diaphragm surface. The system can include an asymmetric exit for the acoustic waves to leave a volume defined between the diaphragm surface and the cover. There can be a minimum gap between at least a portion of the diaphragm surface and at least a portion of the cover of between about 2.5 mm to about 3.5 mm when the diaphragm surface portion is closest to the cover portion during movement of the diaphragm surface.

According to a third aspect of the invention, a sound producing system includes an electro-acoustic transducer having an electromagnetic motor for moving a diaphragm of the transducer back and forth to create acoustic waves that are transmitted to a listening environment outside the system. A solid gas impermeable cover faces the diaphragm surface. There is a minimum gap between at least a portion of the diaphragm surface and at least a portion of the cover of between about 2.5 mm to about 3.5 mm when the diaphragm surface portion is closest to the cover portion during movement of the diaphragm.

The cover can be made of a material that has a magnetic permeability of at least about 900 N/A2. The diaphragm can have a surface that can include one or more of a surface of a dust cap of the diaphragm, a surface of a cone of the diaphragm, and a portion of a surface of a surround of the diaphragm. The cover can have a surface which faces the diaphragm surface, at least a portion of the cover surface having a contour which is substantially the same as a contour of the diaphragm surface. The system can include an asymmetric exit for the acoustic waves to leave a volume defined between the diaphragm surface and the cover surface.

DETAILED DESCRIPTION

Figure 1:
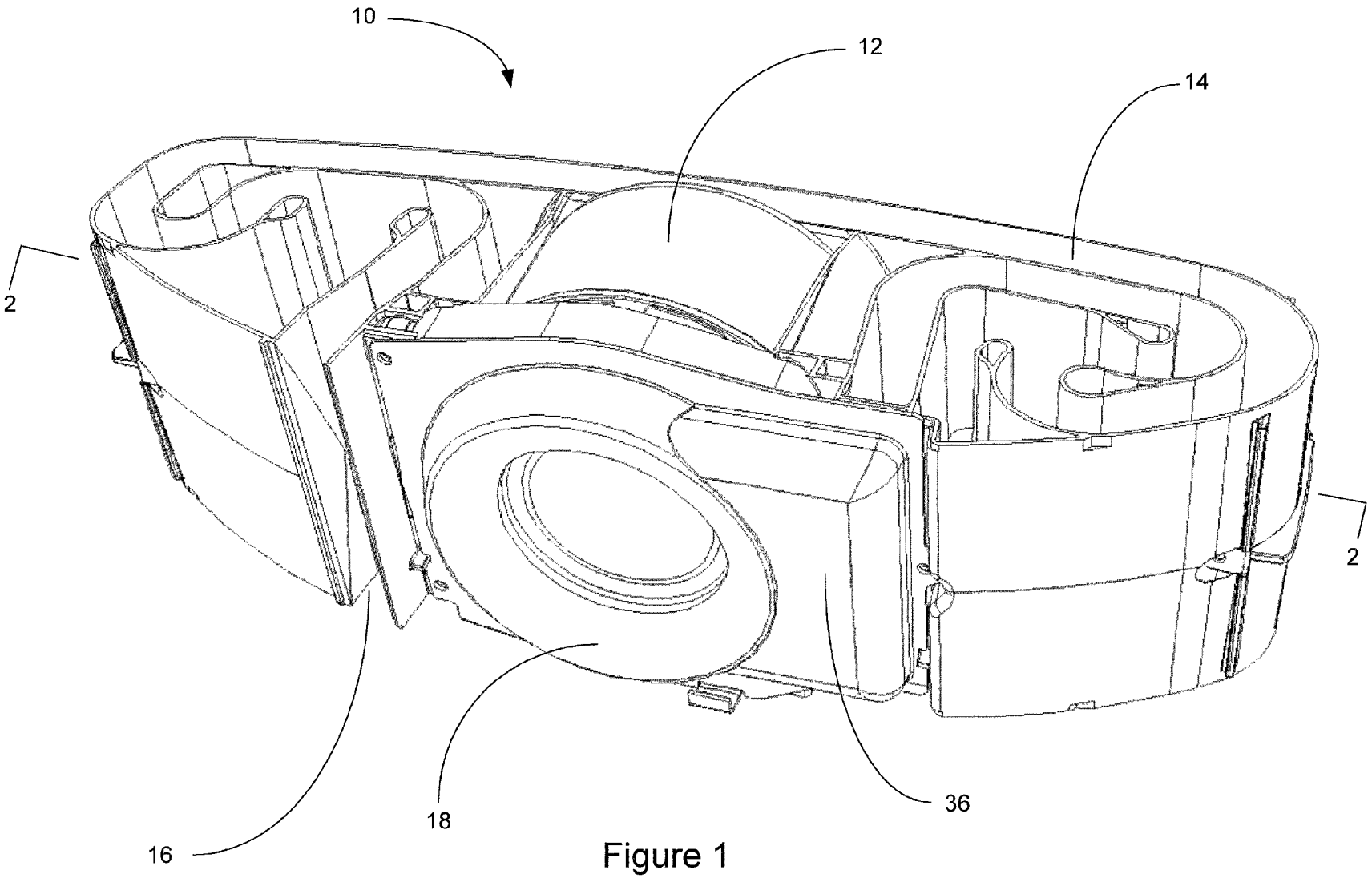
FIG. 1 is a perspective view of a sound producing system.

Referring to FIG. 1, a sound producing system 10 for playing audio out loud is shown. A housing of the system 10 has been removed to facilitate viewing. The system 10 includes an electro-acoustic transducer 12 which in this example is a woofer. The system has a waveguide 14 that includes a waveguide exit 16. Acoustic waves created by the system are transmitted to a listening environment outside the system by the waveguide 14 and waveguide exit 16. A transducer cover 18 is located adjacent to the transducer 12 and is secured to a frame of system 10. The cover is a solid gas impermeable structure that is preferably made of a magnetically permeable material such as cold rolled steel (CRS) that is 1.5 mm thick. One example of CRS is grade 1010 (a low carbon steel) that has a magnetic permeability of about 2.5 k $N/A^2$. Other materials from which the cover 16 can be made include mu-metal which has a magnetic permeability of about 25 k $N/A^2$, Permalloy which has a magnetic permeability of about 5 k $N/A^2$, electrical steel which has a magnetic permeability of about 25k $N/A^2$, and higher carbon content steels which has a magnetic permeability of about 900 $N/A^2$. The cover should be made of a material that preferably has a magnetic permeability of at least about 900 $N/A^2$. Using a higher magnetic permeability material in the cover 18 allows a thinner cover to be used to achieve the same magnetic shielding result.

Using a magnetically permeable material in the cover helps to contain the magnetic field generated by the electromagnetic motor in the transducer 12 (discussed in further detail below). This magnetic field could damage other nearby equipment, such as a video display, if the field is not contained when the system 10 is placed near such equipment. In addition, magnetically permeable materials such as steel tend to be strong which allows the cover to be made relatively thin. Having a thin cover assists in reducing the overall size of the sound producing system. If a plastic cover were used instead of a steel cover, the cover would require a number of ribs to strengthen the cover, thereby increasing the size of the system.

Figure 2:
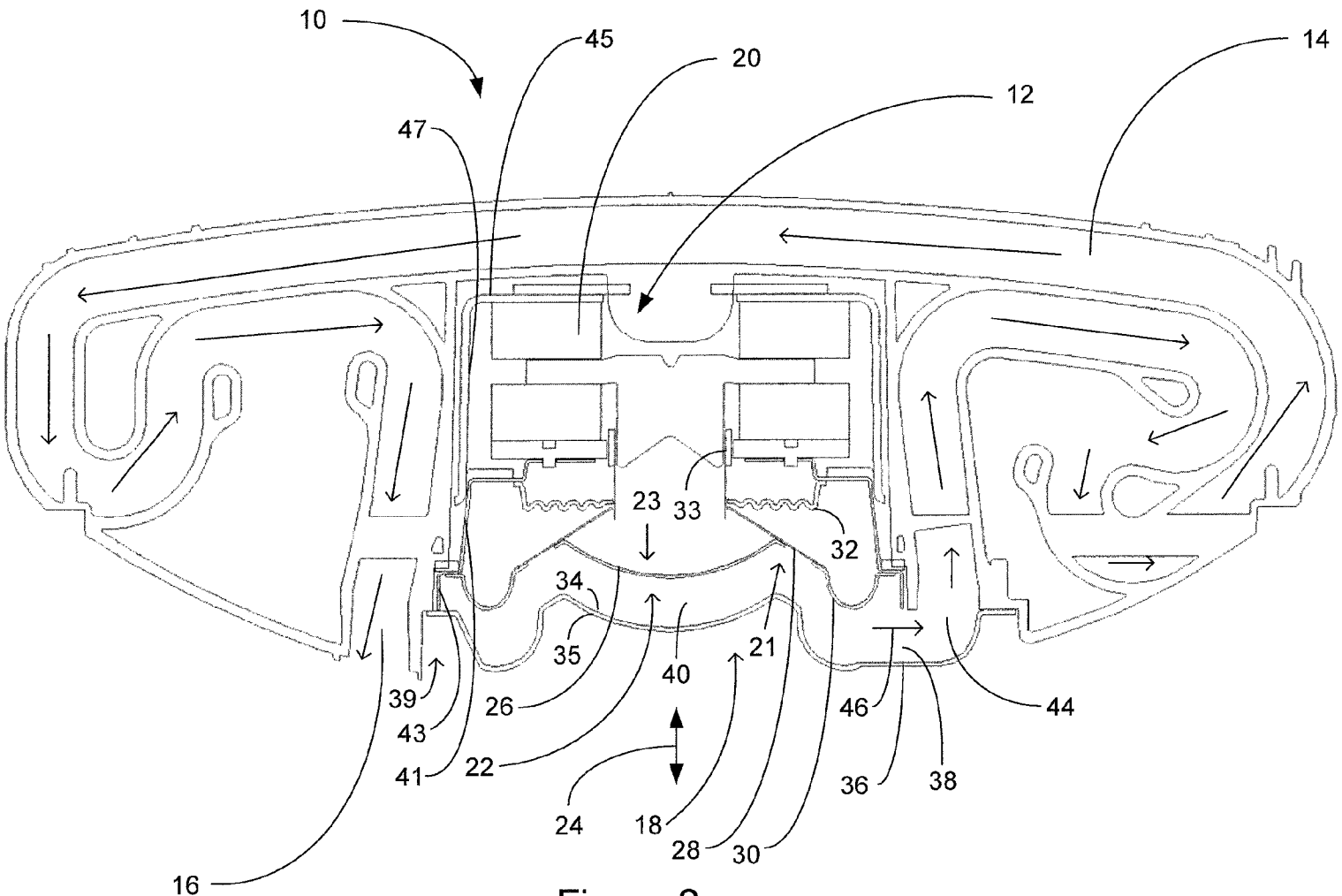
FIG. 2 is a sectional view of FIG. 1 taken along the lines of 2-2 in FIG. 1.

Turning to FIG. 2, the transducer 12 includes an electromagnetic motor 20 that is used to move a diaphragm 21 of the transducer 12 back and forth in a direction 24 to create acoustic waves. The diaphragm 21 includes a front surface 22 and a rear surface 23. The diaphragm 21 is located between the cover 18 and the motor 20. The diaphragm 21 includes one or more of a dust cap 26, a cone 28, and part of a surround 30. As such, the moving surface 22 includes surfaces of one or more of a dust cap 26, a cone 28, and part of a surround 30. The driver also includes a spider 32 for supporting a voice coil 33. The cover 18 faces the front surface 22 of the driver 12. An inner surface 34 of the cover 18 which faces the surface 22 has a contour which is substantially the same as the front surface 22. The cover 18 also has an outer surface 35. The outer surface 35 of the cover 18 does not necessarily need to have a contour that is substantially the same as the surface 22, although in this example that is the case. This feature enables the driver surface 22 to be able to come very close to the surface 34 of the cover 18 at maximum excursion of the surface 22 towards the surface 34 without actually contacting the cover 18.

A minimum gap between surface 22 and surface 34 is preferably between about 2.5 mm to about 3.5 mm when surface 22 is at maximum forward displacement towards surface 34 during movement of surface 22. As such, the overall size of the sound producing system is reduced. This minimum gap maintains sufficient clearance to accommodate part and assembly tolerances, and variation in the maximum travel of surface 22 towards the cover 18 from one driver to another driver. The surface 22 does not contact the cover 18 during movement of the surface 22. In this example, when the system 10 is turned off, the gap between the surfaces 22 and 34 is about 16 mm (this is the home position of surface 22). When surface 22 is being moved by the transducer 12, the surface 22 moves about 13 mm away from its home position in both of the directions 24.

The cover 18 includes an integral portion 36 which partially defines an exit 38 for acoustic waves generated by the surface 22 to leave a volume 40 defined between the surfaces 22 and 34. In this example of the invention the exit 38 is an asymmetric exit because there is no other balancing exit for acoustic waves to get out of the volume 40. If there was a similar acoustic exit at a location 39 then this exit and exit 38 would be a symmetric exit. Providing 3 or more total exits equally spaced about the volume 40 would also provide a symmetric exit. Cover portion 36 also partially defines an entrance 44 to the waveguide 14. Acoustic waves exiting the volume 40 travel in a direction 46 which is substantially perpendicular to the direction of travel 24 of the surface 22. In FIG. 2 the waveguide 14 appears to be blocked at certain points, but this is due to the sectional form of the drawing. Acoustic waves travel in the directions of the arrows shown in the waveguide 14 to the waveguide exit 16.

In this embodiment the cover 18 is in contact with a steel basket 41 of the transducer 12. The steel cover redirects a captured frontal magnetic field and guides it radially outward to the circumference of the cover 18. This magnetic field then flows mostly to a lip 43 of the steel basket. In an alternative embodiment there is a small gap between the cover 18 and the basket 41 which results in reduced magnetic shielding, but also reduces the chances of the cover 18 and basket 41 vibrating against each other. The basket 41 is in contact with a steel can 45 of the transducer 12. As a result, the magnetic field then flows from the lip 43 of the basket 41 to a side 47 of the can 45, and then flows to a bottom of the can shown at reference numeral 45. In an alternative embodiment there is a small gap between the basket 41 and the can 45 which results in reduced magnetic shielding, but also reduces the chances of the basket 41 and can 45 vibrating against each other.

Figure 3B:
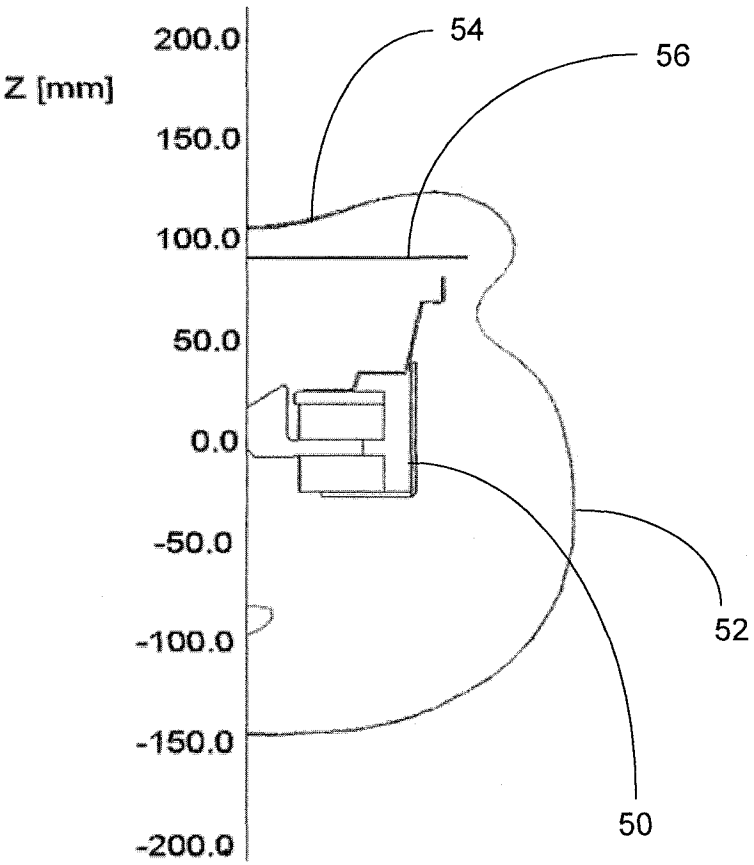
FIG. 3B is a partial sectional view of the electro-acoustic transducer of FIG. 3A with a steel cover.
Figure 3A:
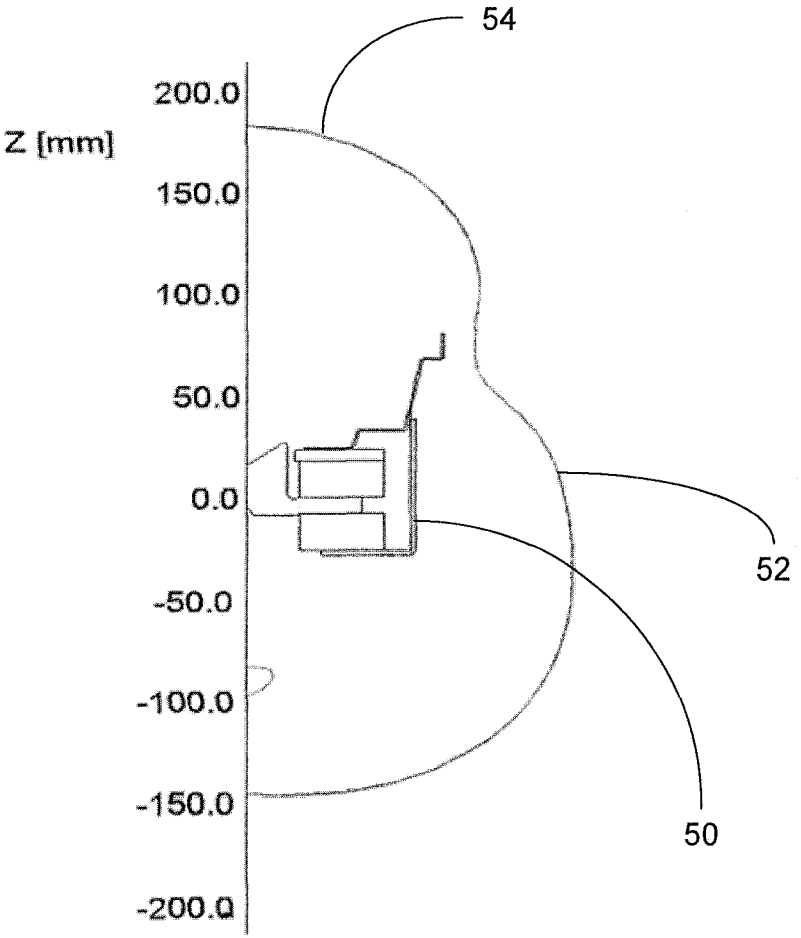
FIG. 3A is a partial sectional view of an electro-acoustic transducer without a steel cover.

FIGS. 3A and 3B show a finite element analysis for one embodiment which illustrates how a steel cover contains magnetic flux generated by an electro-acoustic transducer. In FIG. 3A a portion of an electroacoustic transducer 50 is shown without a steel cover. The transducer, when operated, creates magnetic flux which is represented by a line of constant magnetic flux 52. Note that a portion 54 of the flux line 52 extends a fair distance away from the transducer 50. In FIG. 3B a flat steel cover 56 has been added. As shown, the portion 54 of the magnetic flux line 52 is contained much closer to the transducer 50 than occurred in FIG. 3A. A similar effect will occur with the contoured steel cover shown in FIGS. 1-2. The steel cover returns magnetic flux to a frame of the driver. This effect would not be obtained if the cover was made of a non-ferrous material While the invention has been particularly shown and described with reference to specific exemplary embodiments, it is evident that those skilled in the art may now make numerous modifications of, departures from and uses of the specific apparatus and techniques herein disclosed. Consequently, the invention is to be construed as embracing each and every novel feature and novel combination of features presented in or possessed by the apparatus and techniques herein disclosed and limited only by the spirit and scope of the appended claims.

What is claimed is:

1. A sound producing system, comprising:

an electro-acoustic transducer having an electro-magnetic motor for moving a diaphragm of the transducer back and forth to create acoustic waves, the diaphragm having a surface that includes one or more of a surface of a dust cap of the diaphragm, a surface of a cone of the diaphragm, and a portion of a surface of a surround of the diaphragm; and a solid gas impermeable cover that faces the diaphragm surface, the cover having a surface which faces the diaphragm surface, at least a portion of the cover surface having a contour which is substantially the same as a contour of the diaphragm surface, wherein the system includes an asymmetric exit for the acoustic waves to leave a volume defined between the diaphragm surface and the cover surface.

2. The system of claim 1, wherein there is a minimum gap between at least a portion of the diaphragm surface and at least a portion of the cover surface of between about 2.5 mm to about 3.5 mm when the diaphragm surface portion is closest to the cover surface portion during movement of the diaphragm surface.

3. The system of claim 1, wherein the cover is made of a material that has a magnetic permeability of at least about 900 $N/A^2$.

4. The system of claim 3, wherein the cover is made of cold rolled steel.

5. The system of claim 1, wherein the cover includes an integral portion which partially defines the exit.

6. The system of claim 5, wherein the integral portion of the cover also partially defines an entrance to a waveguide of the system.

7. The system of claim 1, wherein the diaphragm surface includes both the surface of the dust cap and the surface of the cone.

8. The system of claim 1, wherein acoustic waves exiting the volume defined between the diaphragm surface and the cover surface travel in a direction which is substantially perpendicular to a direction of travel of the diaphragm surface.

9. A sound producing system, comprising:

an electro-acoustic transducer having an electro-magnetic motor for moving a diaphragm of the transducer back and forth to create acoustic waves that are transmitted to a listening environment outside the system; and a solid gas impermeable cover that faces the diaphragm, wherein the cover is made of a material that has a magnetic permeability of at least about 900 $N/A^2$.

10. The system of claim 9, wherein the diaphragm includes a surface that includes one or more of a surface of a dust cap of the diaphragm, a surface of a cone of the diaphragm, and a portion of a surface of a surround of the diaphragm;

wherein the cover has a surface which faces the diaphragm surface, at least a portion of the cover surface having a contour which is substantially the same as a contour of the diaphragm surface.

11. The system of claim 9, wherein the system includes an asymmetric exit for the acoustic waves to leave a volume defined between the diaphragm surface and the cover surface.

12. The system of claim 9, wherein there is a minimum gap between at least a portion of the diaphragm surface and at least a portion of the cover of between about 2.5 mm to about 3.5 mm when the diaphragm surface portion is closest to the cover portion during movement of the diaphragm surface.

13. A sound producing system, comprising:

an electro-acoustic transducer having an electro-magnetic motor for moving a diaphragm of the transducer back and forth to create acoustic waves that are transmitted to a listening environment outside the system;

a waveguide for conducting the acoustic waves to the listening environment; and a solid gas impermeable cover that faces the diaphragm, wherein there is a minimum gap between at least a portion of the diaphragm and at least a portion of the cover of between about 2.5 mm to about 3.5 mm when the diaphragm portion is closest to the cover portion during movement of the diaphragm.

14. The system of claim 13, wherein the cover is made of a material that has a magnetic permeability of at least about 900 N/A2.

15. The system of claim 13, wherein the diaphragm has a surface that includes one or more of a surface of a dust cap of the diaphragm, a surface of a cone of the diaphragm, and a portion of a surface of a surround of the diaphragm; wherein the cover has a surface which faces the diaphragm surface, at least a portion of the cover surface having a contour which is substantially the same as a contour of the diaphragm surface.

16. The system of claim 13, wherein the system includes an asymmetric exit for the acoustic waves to leave a volume defined between the diaphragm surface and the cover surface.

17. The sound producing system of claim 9, wherein the transducer further includes a can made of a magnetically permeable material, wherein the cover and the can form at least part of a path for a magnetic field produced by the motor.

18. The sound producing system of claim 17, wherein the transducer further includes a basket made of a magnetically permeable material, wherein the basket is included in the path for the magnetic field produced by the motor.

19. The sound producing system of claim 18, wherein the cover and basket are in direct contact with each other.

20. The sound producing system of claim 18, wherein there is a gap between the cover and basket.

21. The sound producing system of claim 18, wherein the can and basket are in direct contact with each other.

22. The sound producing system of claim 18, wherein there is a gap between the can and basket.

* * * * *